US008870522B2

(12) United States Patent
Reischmann et al.

(10) Patent No.: US 8,870,522 B2
(45) Date of Patent: Oct. 28, 2014

(54) CENTRIFUGAL PUMP

(75) Inventors: Wolfgang Reischmann, Argenbühl (DE); Alexej Vaulin, Friedrichshafen (DE); Joachim Ruck, Langenargen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 661 days.

(21) Appl. No.: 13/065,805

(22) Filed: Mar. 30, 2011

(65) Prior Publication Data

US 2011/0250059 A1 Oct. 13, 2011

(30) Foreign Application Priority Data

Apr. 9, 2010 (DE) ..... 10 2010 003 838

(51) Int. Cl.
*F04D 29/10* (2006.01)
*F01D 11/00* (2006.01)

(52) U.S. Cl.
USPC ..... 415/111; 415/230; 416/174

(58) Field of Classification Search
USPC ..... 415/110, 111, 229, 230, 170.1; 416/174
See application file for complete search history.

(56) References Cited

U.S. PATENT DOCUMENTS

| | | | | |
|---|---|---|---|---|
| 3,076,412 | A * | 2/1963 | Harker et al. | 415/170.1 |
| 5,195,867 | A | 3/1993 | Stirling | |
| 7,008,177 | B2 | 3/2006 | Britt et al. | |
| 8,506,238 | B2 * | 8/2013 | Slike et al. | 415/106 |

* cited by examiner

*Primary Examiner* — Edward Look
*Assistant Examiner* — Christopher J Hargitt
(74) *Attorney, Agent, or Firm* — Klaus J. Bach

(57) ABSTRACT

In a centrifugal pump, in particular a radial or semi-axial pump including a housing with a pump chamber and a dry chamber, a drive shaft rotatably supported in the housing and connected to an impeller for pumping a liquid flow medium disposed in the pump chamber and a shaft seal arranged in an inner radial area for sealing the dry space with respect to the flow medium, a seal carrier is provided with a guide structure by which fluid flow medium is conducted from an outer radial area to an inner radial area for directing flow medium into the seal for lubrication and cooling of the seal.

8 Claims, 6 Drawing Sheets

CENTRIFUGAL PUMP

BACKGROUND OF THE INVENTION

The invention relates to a centrifugal pump, in particular, a radial pump or a semi-axial pump including a housing with a pumping space and a dry space, a drive shaft rotatably supported in the housing and an impeller wheel firmly connected to the drive shaft for pumping a flow medium in the pumping space, and a shaft seal arranged in an inner radial area for sealing the dry space with respect to the flow medium wherein at least a part of the shaft seal is held in position by a seal cover connected to the housing.

A centrifugal pump of this type for pumping a liquid flow medium is used in particular for pumping sea water in ships. In such an application, a centrifugal pump of the type referred to above is exposed to comparably high stresses. Still a reliable operation is necessary even after an extended shutdown.

It is a problem with centrifugal pumps for pumping a liquid flow medium that a shaft seal during initial operation of the pump is not contacted by the flow medium, that is, it is in a comparably dry state. This affects the shaft seal in a disadvantageous way. The dry state during operation of the centrifugal pump for pumping the liquid flow medium may result from a condition whereby the shaft seal is not in contact with the flow medium because of air in the flow medium. It has been found that during starting operation particularly of radial pumps or semi-axial pumps the liquid flow medium moves along the radially outer areas because of the centrifugal forces whereas the air content collects in the radially inner area that is around the shaft seal. Such dry run operating states of a centrifugal pump can have substantial disadvantages for the shaft seal such as insufficient lubrication and/or cooling of the shaft seal by the flow medium. As a result, there may be increased wear of the shaft seal which reduces the life of the shaft seal. In a worst case, with an insufficient lubrication and/or cooling, tensions in the material of the shaft seal can detrimentally affect other parts of the centrifugal pump and may result in irreparable damages.

It would be desirable to avoid the detrimental effects of dry running states experienced by centrifugal pumps.

It is therefore the object of the present invention to provide means by which the durability of centrifugal pumps is increased and, specifically, dry running conditions of a shaft seal are largely avoided even during startup operation of the pump.

SUMMARY OF THE INVENTION

In a centrifugal pump, in particular a radial or semi-axial pump including a housing with a pump chamber and a dry chamber, a drive shaft rotatably supported in the housing and connected to an impeller for pumping a liquid flow medium disposed in the pump chamber and a shaft seal arranged in an inner radial area for sealing the dry space with respect to the flow medium, a seal carrier is provided with a guide structure by which fluid flow medium is conducted from an outer radial area to an inner radial area for directing flow medium into the seal for lubrication and cooling of the seal.

Preferably, the centrifugal pump is a radial pump or a semi-axial pump. The concept is particularly suitable for use in connection with centrifugal pumps pumping sea water, or respectively, seawater centrifugal pumps.

According to the invention, in a system comprising a centrifugal pump and a drive for the centrifugal pump, the drive is an internal combustion engine, preferably a Diesel engine. The system is arranged on a ship preferably with a ship Diesel engine.

The invention is based on the consideration that during standstill or respectively startup operation of a centrifugal pump, there is an unfavorable distribution of liquid flow medium with—in particular, in connection with sea water pumps—a high air content in the intake flow medium. The inventors have recognized that, upon an extended shut-down of the centrifugal pump, during startup operation a situation can develop where the liquid flow medium—in particular sea water—is collected, because of the centrifugal forces, at the radially outer area within the pump housing while at the radially inner area of the housing of the centrifugal pump an air pocket is formed. It has been found that the formation of such an air pocket in the area of the shaft seal while it is already rotating detrimentally affect the lubrication and/or cooling of the shaft seal by the liquid flow medium.

The inventors have also found that it is possible to avoid such unfavorable operating conditions or at least shorten them by providing on the seal carrier at a surface facing the impeller wheel a guide structure by which flow medium can be conducted from a radially outer area to the radially inner area when the impeller wheel rotates during operation of the pump. Although, with the rotation of the shaft carrying the rotor the liquid flow medium is driven to the radially outer area of the pump housing by the centrifugal forces, part is returned to the radially inner area by the guide structure. The guide structure is in accordance with the invention formed by an axially projecting guide surface which extends inclined against the direction of rotation of the impeller during operation of the pump. The guide structure causes a distribution of the flow medium carried along by the impeller so as to be guided in a direction opposite to the centrifugal forces that is from the radially outer area toward the radially inner area. In order to make this effect as advantageous as possible, it is further provided that the guide structure surface, that is essentially a limit contour between the guide surface and the surface area, extends from the radially outer area to the radially inner area.

In other words, the seal carrier is stationary and as a result has a guide structure which is stationary with respect to the drive shaft which counteracts a centrifugal force-induced distribution of an amount of liquid flow medium carried along by the impeller. The centrifugal force-caused distribution of the liquid flow medium in the presence of a high air content of a centrifugal pump during start-up operation results generally in an annular distribution in an outer radial area between the seal carrier and the impeller and in an inner radial area, in particular in the area of the shaft seal, the formation of an air pocket.

The area is in particular part of a front side of the seal carrier facing the pumping chamber wherein the front side is arranged opposite a backside of the impeller facing away from the pumping chamber. The outer radial area and the inner radial area are advantageously areas of an annular chamber which is disposed between the seal carrier and the impeller and through the innermost radial area of which the drive shaft extends. The invention has been found to be particularly advantageous for a centrifugal pump in the form of a radial pump or a semi-axial pump. Herein, the pumping takes place from a suction side of the pumping chamber to a pressure side of the pumping chamber. The suction side of the pumping chamber is herein always at an inner radial area of the pumping chamber whereas the pressure side of the pumping chamber is always at the radially outer area of the pumping chamber. In connection with radial pumps or semi-axial pumps, the embodiment of the invention described above has been found to be particularly helpful and effective.

Basically, the shaft seal may be in any form suitable for the operation of the centrifugal pump, for example in the form of a radial shaft seal, a labyrinth seal or a friction or slide ring seal. The slide ring seal has been found to be particularly advantageous and reliable. At the same time, the concept of the present invention has been found to be expedient and effective in connection with a slide ring seal since the cooling and lubrication needs are comparatively high for slide ring seals.

In a slide ring seal, at least one part of the shaft seal is held by the seal carrier as a counter ring and another part of the seal ring is fixed to the impeller as a slide ring. A slide ring seal includes a slide ring which rotates together with the impeller during its operation. The slide ring seal also includes a counter ring fixed to the seal carrier and, consequently, the housing so as to be non-rotatable. The slide ring and the counter ring may further include additional suitable axial shaft seal rings or similar devices in order to form a secondary seal which is arranged directly at the drive shaft with a slide ring or respectively, a counter ring. The opposite axial or radial seal surfaces of the slide ring and the counter ring rotate relative to each other during operation of the centrifugal pump and form a so-called primary sealing gap in which advantageously a liquid lubricant film of the liquid flow medium is formed. The slide ring and the counter ring are engaged for example by a spring force in order to keep the seal gap narrow. The additional auxiliary seals in the form of seal rings arranged directly on the drive shaft are provided to seal the slide ring or, respectively, the counter ring with respect to the shaft.

In a particularly preferred embodiment of the invention, the guide structure is in the form of a protruding deflector structure. Preferably, the deflector structure is formed by the side surface of a rib, a web or a similar structure. Basically any shape may be provided for the guide surface such as a shovel, a flag, a protrusion or other raised area with a suitably curved guide surface; it is however advantageous if the deflection surface is a side surface of a rib or web or another projection which can be formed comparably easily. An existing centrifugal pump can be easily modified by the installation of a rib or web to form a deflection area. Especially during startup operation of the centrifugal pump, in this way, liquid flow medium is conducted from the radially outer area to the radially inner area for the lubrication and cooling of the shaft seal. In this way, the shaft seal stresses are advantageously reduced in that the dry running period is substantially shortened. In addition, a cooling effect is obtained and the temperature at the shaft seal, in particular in the sealing gap of the slide ring seal is more uniform. Tensions within the components of the shaft seal are effectively suppressed.

Overall, it has been found to be advantageous if the height of the deflection surface area corresponds essentially to the height of a part of the shaft seal. Such adjustment of the height of the deflection surface to the height of a part of the shaft seal—in particular the slide ring and/or the counter ring of a slide ring seal—results in a comparably good supply of flow medium to the shaft seal, in particular a slide ring seal. In particular, with the tuning of the height of the deflection surface and a part of the shaft seal in accordance with the above-described embodiment, the flow medium is conducted—as seen in axial direction—practically to the level of the seal gap toward the shaft seal and a flow pressure of the cooled flow medium is comparatively high at a seal gap inlet openings. In particular, the flow medium can be conducted thereby directly into the seal gap. This results in a further improved, particularly effective and rapid cooling and lubricating effect of the cooling medium in the seal gap of the shaft seal. This concept can be realized in that a level of the projecting deflecting area corresponds essentially to the level of a slide ring of a slide ring seal. Preferably, a countering of the slide ring seal is included in the seal carrier.

The term contour course of the deflection area relative to the support area on which it is formed refers particularly to the course of a tangential transition contour between the support area and the deflection area. Further, however as contour course, the basic course of the deflection area in an axial view of the support area is to be understood. The contour course basically may extend in any way which is advantageous for conducting the flow medium from the radially outer area to the radially inner area. In particular, the contour extends from an outermost radial are, advantageously an outer most edge area of an annular chamber, to the innermost radial area, preferably the innermost edge area of an annular chamber which is defined by the outer diameter of the drive shaft. With a contour course extending from the outermost edge area of the annular chamber to the innermost edge area of the inner annular chamber, it is ensured that the volume of the outer annular chamber is thoroughly covered for conducting flow medium to the inner edge area.

The contour may be straight lined or curved; in particular the contour may extend from the outer radial area to the inner radial area along, or at an angle to, a radial line of the annular chamber. In other words, by extrapolation the contour may extend through a center line of the drive shaft.

In a modification, the contour may extend from the outer radial area to the inner radial area also along a tangent to the drive shaft and/or along a secant of the annular chamber. In other words, the contour does not extend—extrapolated—through the center drive shaft but past the center in spaced relationship therefrom. It has been found advantageous if, in a further development, the contour extends along a tangent to the shaft circumference of the drive shaft. The contour curves described above and the variants thereof have been found to be particularly advantageous for conducting flow media toward the shaft seal.

For an increased effectiveness of the concept according to the invention, an inclination of the guide surface can be established which extends at least partially at an angle with respect to a rotational direction of an impeller. The inclination is indicated here with respect to a horizontal radial line; it may be for example an angle between 90° and 0°. At 90°, the guide area extends normal to the rotational direction of the impeller. An angle between 15° and 75°, and particularly between 30° and 60° has been found to be particularly effective. With a decreasing inclination angle, the guide area extends comparably flat with regard to the impeller with a rotating seal ring. A small angle may provide for less friction and will provide, particularly at higher speeds, still for an effective redirecting of the flow medium toward the shaft seal. This is particularly true for a contour curve which extends along a tangent to the shaft circumference.

The guide structure is connected to, particularly releasably connected to, the seal carrier. The guide structure may in particular be so designed that it can be retrofitted to a centrifugal pump. The guide structure may also be adjustably mounted to a surface of the seal carrier which axially faces the impeller. For example, an inclination angle and/or a course curve may be adjustable so as to provide for the most effective redirection of flow medium toward the shaft seal.

Exemplary embodiments of the invention will be described below with reference to the accompanying drawings.

DESCRIPTION OF EXEMPLARY EMBODIMENTS

Figure 1:
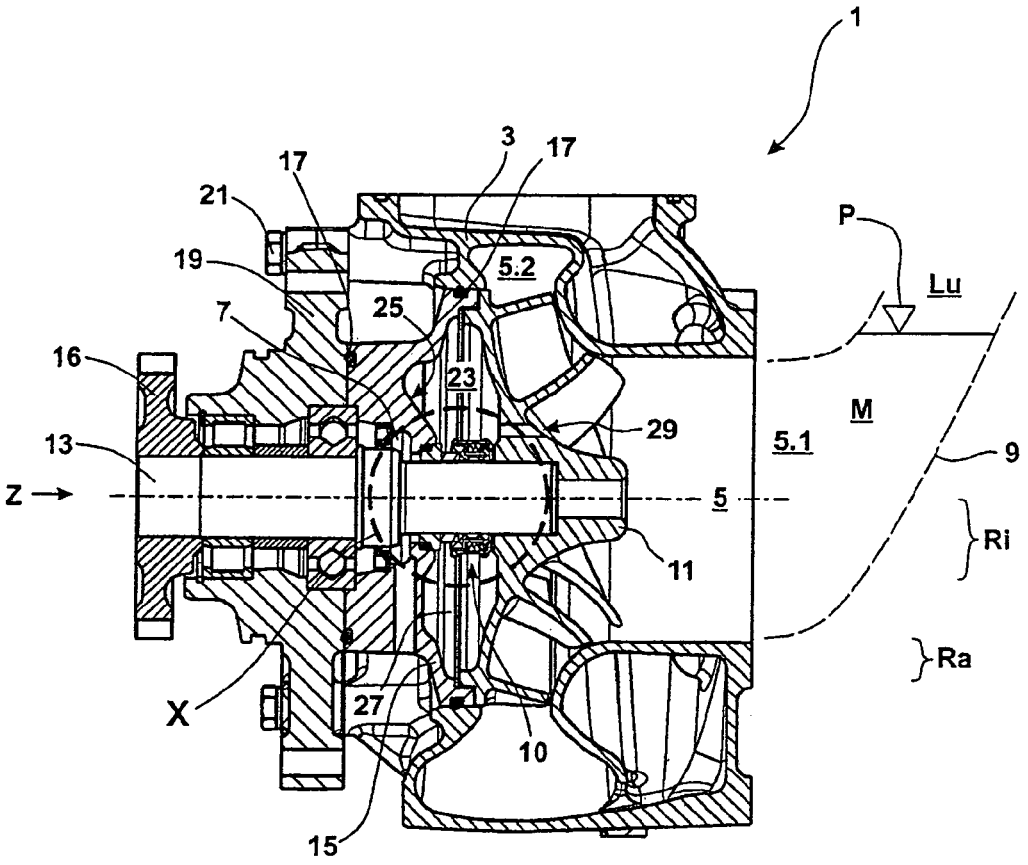
FIG. 1 shows in an axial cross-sectional view a preferred embodiment of a radial centrifugal pump.
Figure 2A:
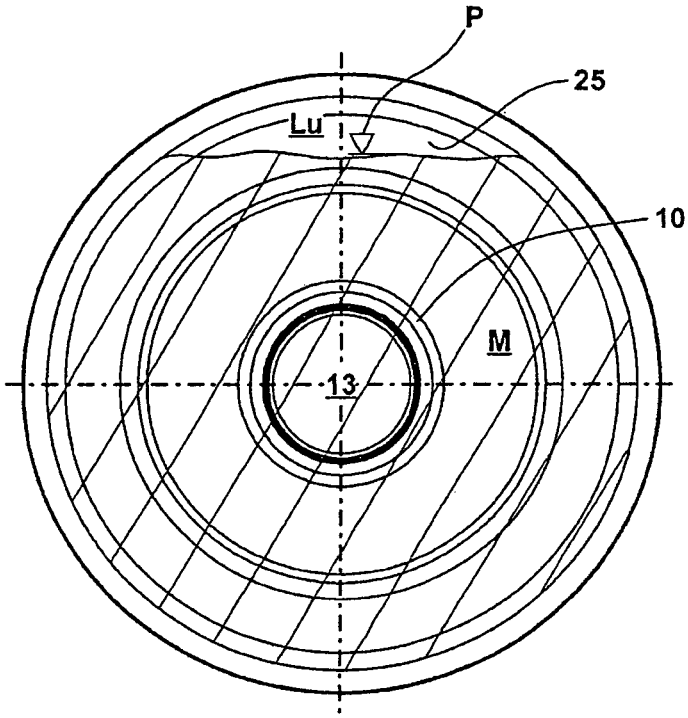
FIG. 2A is an axial view of a seal carrier of a radial pump of the state of the art with a schematically indicated level P for a flow medium in an annular chamber formed between the seal carrier and the impeller when the pump is not in operation.

FIG. 1 shows a centrifugal pump 1 for use as seawater pump in the form of a radial pump. The radial pump includes a pumping chamber 5 surrounded by a housing 3 and a dry space 7 sealed with respect to a liquid flow medium M in the form of a sea water which reaches, at a standstill of the centrifugal pump 1, generally to a level P of a symbolically shown surface. Above the level P in the siphon 9 air Lu is disposed above the sea water. With the level P air is also disposed in the pump 1 above the level P as shown in FIG. 2A.

The centrifugal pump 1 in the form of a radial pump is designed to pump the flow medium M in the form of sea water from a suction side 5.1 of the pump chamber 5 to a pressure side 5.2 of the pump chamber 5. To this end, the radial pump includes, in the pump chamber 5, a pump wheel in the form of a rotatably supported impeller 11 for pumping the liquid flow medium M contained in the pump chamber 5. The impeller 11 is disposed on a rotatable drive shaft 13, on which it is firmly mounted. The drive shaft 13 can be driven by a motor, which is not shown, via a gear 16. In order to prevent the liquid flow medium M from entering the dry space 7 of the housing 3 from the pump chamber 5, the radial pump includes various seals on the housing 3 and in the area of the drive shaft 13.

The housing 3 comprises several parts and includes a seal carrier 15 arranged at the backside of the pump impeller 11 which is sealed by seals 17 with respect to the rest of the housing 3 and especially with respect to other housing parts 19. The other housing parts 19 and the seal carrier 15 or, respectively, the housing 3 may be interconnected for example by means of bolts 21. For sealing the dry space 7 in the area of the drive shaft 13 from the flow medium M the radial pump disclosed herein includes a shaft seal in the form of a slide ring seal 10 which is shown in the detail X of FIG. 1. In radial direction, the shaft seal in the form of the slide ring seal 10 is disposed in an inner radial area R in which essentially also the suction side 5.1 of the pump chamber 5 is disposed. The pressure side 5.2 of the pump chamber 5 is arranged essentially in an outer radial area $R_a$.

Figure 1A:
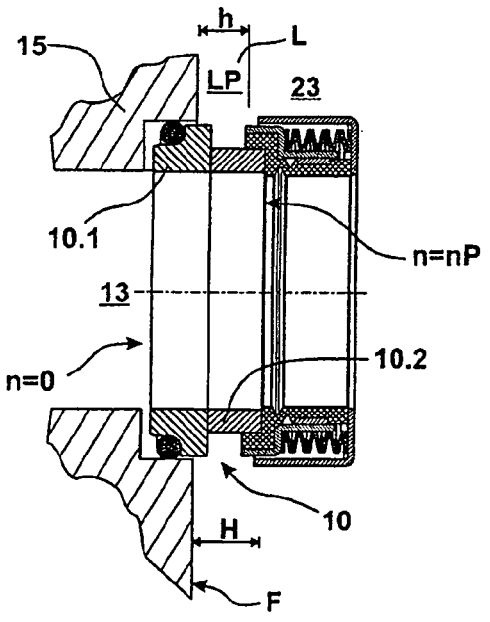
FIG. 1*a* shows the detail X of FIG. 1 representing the seal carrier with a guide structure with a height H of a guide area corresponding essentially to the height H of a counter ring of a slide ring seal.

The slide ring seal 10 is arranged in the inner radial area $R_i$ in an annular chamber 23 which, in the axial direction Z, is provided between the dry space 7 and the pump chamber 5. As shown the annular chamber 23 is delimited by a front side 25 of the seal carrier facing the pump chamber 5 and a backside 27 of the impeller 11 facing away from the pump chamber 5. As a result, the seal carrier 15 includes a surface area F which in axial direction Z faces the impeller 11, specifically the backside 27 thereof and which is part of the front side 25 mentioned earlier. The surface area F may be planar, profiled or curved or structured in any other way. In the surface area F, at the drive shaft 13—that is, in the radially inner area $R_i$—a counter ring 10.1 of the slide ring seal 10 is provided fixed in the seal carrier 15. That is, the counter ring 10.1 of the slide ring seal 10 is firmly connected to the seal carrier 15 so that it cannot rotate with the drive shaft 13. Further details of the counter ring are not shown but it is of any suitable design. Onto the counter ring 10.1, a slide ring 10.2 of the slide ring seal is pressed so as to form a seal gap which is not indicated. An engagement pressure may be provided in this case for example by a seal spring. The slide ring 10.2 is fixed to the impeller 11 for rotation therewith. As a result, the slide ring 10.2 of the slide ring seal 10 rotates together with the impeller 11 and slides sealingly along the counter ring 10.1 of the slide ring seal 10 which forming a seal gap at the counter ring 10.1 of the slide ring seal 10. To make this apparent, a rotational speed n=0 is indicated in the detail drawing X whereas for the slide ring 10.2 a pump speed of the motor n=nP is indicated in FIG. 1*a*.

Since the counter ring 10.1 is largely accommodated within the front face 25 of the seal carrier 15, the seal gap of the slide ring seal 10 is arranged in axial direction only little over the surface area F. The additional section of the slide ring 10.2 of the slide ring seal 10 therefore establishes a height value H which extends in axial direction Z above the surface area F within the annular chamber 23.

Figure 2B:
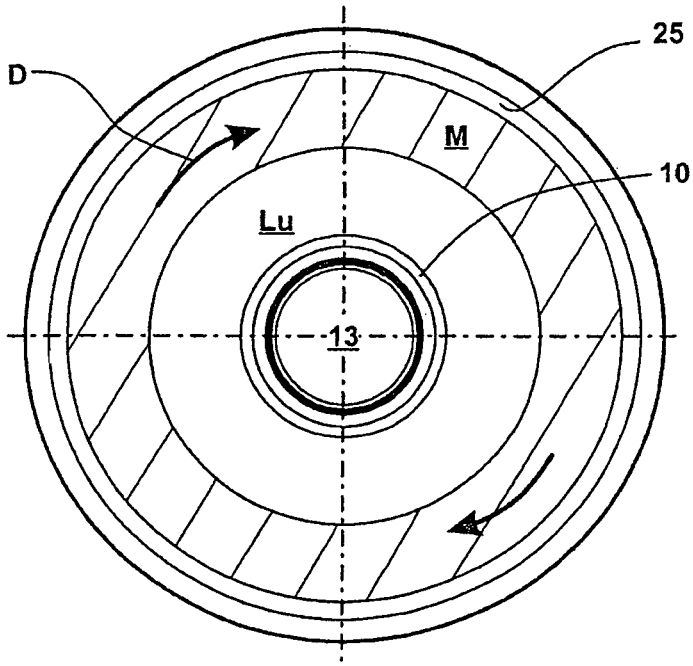
FIG. 2B shows schematically a centrifugal force-caused distribution of the flow medium during startup operation of the pump.

FIGS. 2A and 2B show conventional seal ring structures. As shown in FIGS. 2A and 2B during standstill of the centrifugal pump which is in the form of a radial pump a seawater level P corresponding to the sea water level in the siphon 9 is established in the annular chamber 23 with air Lu being above the level P. FIGS. 2A, 2B show the front face 25 of the seal carrier 15 in an axial view from the backside 27 of the impeller 11. The distribution of the flow medium M in the form of sea water is indicated symbolically in FIG. 2A. It is apparent that, during standstill of the radial pump, the slide ring seal is in contact with the flow medium M. AS a result, the seal gap of the slide ring seal is lubricated by the flow medium but otherwise provides for a seal with respect to the flow medium M. In the situation shown in FIG. 2A, however, the flow medium level P may be lowered so that the slide ring seal 10 is for example only partially flooded by the flow medium M.

In FIG. 2B, the centrifugal force causes a distribution of the flow medium M during startup operation of the radial pump as shown. As shown, an impeller 11 rotating in the direction D causes the flow medium M to be carried along as a result of friction forces on the backside 27 of the impeller 11 into a rotational movement in the direction of rotation D independently of the level P of the flow medium. As a result of the centrifugal forces caused by the rotation, an annular distribution of the flow medium M in the annular chamber 2 between the front side 25 of the seal ring carrier 15 and the backside 27 of the impeller is established. This circular distribution of the flow medium M in an outer radial area $R_a$ of the annular chamber 23 has the result that in the inner radial area $R_1$ of the annular chamber practically no flow medium M but rather an air pocket is present. As a result, a seal gap between the relatively rotating slide ring 102 and counter ring 10.1 is no longer in contact with the flow medium M. The sea water therefore can no longer Contribute to the lubrication of the slide ring seal 10 nor to the cooling of the slide ring seal 10.

The annular chamber 23 includes a pressure relief bore 29 for causing a pressure balance between the annular chamber 23 and the pumping chamber 5 and, furthermore, to pump air present in the annular chamber 23 to the suction side 5.2 of the pumping chamber 5.

As apparent from the detail representation. X, FIG. 1A in the embodiment, which has further been described in accordance with the concept according to the invention, a guide structure L is provided on the front face F facing the impeller 11, that is, on the front face 25 of the seal carrier 15 which guide structure L extends into the annular chamber 23. In the following embodiments as shown in FIGS. 3 to 6, the guide structure L is so designed that, upon rotation of the impeller 11, flow medium M from the outer radial area $R_a$ is directed to the inner radial area As apparent from the detailed structure X of FIG. 1A, the guide structure L extending into the annular chamber 23 has there a height h which corresponds essentially to the height h of the slide ring 10.2 of the slide ring seal 10. The guide structure L is so designed that it conducts sea water into the seal gap of the slide ring seal 10 as effectively as possible when the impeller 11 rotates. The guide structure 2 is intended to eliminate the centrifugal force-caused distribution of the sea water as shown in FIG. 2B, but rather conducts at least a part from the flow medium M from the outer radial area $R_a$ to the inner radial area $R_i$ so that also during start-up operation of the radial pump a seal gap of the slide ring seal 10 can be lubricated and the slide ring seal can be cooled.

In tests it has indeed been found that an initially unavoidable temperature increase in the slide may seal 10 is rapidly reduced by the described arrangement—that is, with a guide structure L on the seal carrier 15 for conducting the flow medium M from the outer radial area $R_a$ to the inner radial area $R_i$, the temperature is reduced faster than with other pumps without the guide structure L. As a result, the temperature in the slide ring seal 10, in particular in the seal gap, that is in the contact area between the counter ring 10.1 and the slide ring 10.2, becomes uniform. In this way, tensions in the slide ring seal 10 can effectively suppressed. This again positively affects the slide ring seal 10 which is an essential part of the radial pump. In addition, the formation of air pockets within the annular chamber 23 can practically be prevented with an appropriate design of guide structure L.

The embodiments shown in FIGS. 3 to 6 show various solutions in accordance with the concept of the present invention which are comparatively simple and can be realized inexpensively. In particular, a sea water pump as shown in FIG. 1 can be retrofitted with a guide arrangement L as shown in detail X of FIG. 1A.

A system comprising the centrifugal pump 1 shown herein in the form of a radial pump and a drive in the form of an internal combustion engine specifically a Diesel engine—which is not shown—has a relatively long life without the need for service. In any case, the guide structure shown can be replaced or adjusted for efficiently conducting the flow medium M in the annular chamber 23. The system is particularly suitable for use on ships or other sea vehicles.

Basically, the guide structure L may for example have a deflecting area LP which is shown in the detail X of a FIG. 1A in an exemplary way and which projects from the surface area F. Below, for identical or similar parts or parts performing the same or similar functions expediently the same reference numerals are used. The FIGS. 3 to 6 show that the surface area F at the front side 25 of the seal carrier 15 does not need to be planar, but may be structured. In the exemplary embodiment, it is provided for example with annular areas each of which forms a planar surface area. In all shown embodiments of a radial pump a seal carrier 15.1 to 15.4 is provided with a front side 25 which has a circular surface area forming the impeller 11. As noted, the surface area F is not commonly planar but comprises several annular individually planar sections which are stepwise delineated from one another.

Figure 3:
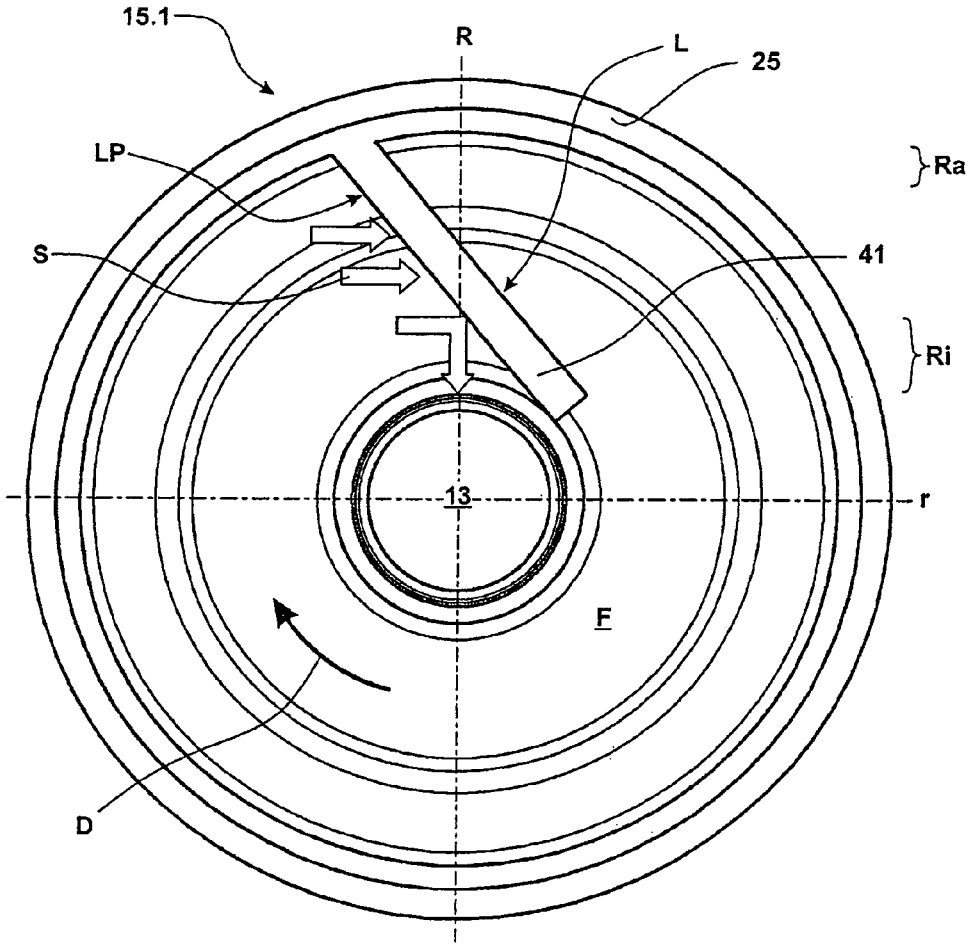
FIG. 3 is an axial view of a seal carrier of a radial pump with a guide structure in a first embodiment with a schematically shown deflection of the flow medium.

FIG. 3 shows in an axial view the front side 25 of a seal carrier 15.1 the surface F and the drive shaft 13 of a first embodiment of a radial pump.

On the front side 25 of the seal ring carrier 15.1, there is a guide structure L which is formed as a single web 41 on the surface F. The web H includes as side surface a deflecting area LP protruding from the side surface. Such a deflective surface shown already in the detail X of FIG. 1A has a height h which corresponds about to the height dimension 11 of the slide ring 10.2 of the slide ring seal 10 and has the advantages mentioned earlier.

The deflecting surface LP has a contour which extends from a radially outer area $R_a$ of the annular chamber 23 to a radially inner area $R_i$ transversely to a radius R which extends from the center point of the drive shaft 13.

As apparent from FIG. 3, the deflecting surface area LP of the web 41 extends herewith transversely to the direction of rotation D of the flow medium M in the annular chamber 23 during start-up operation of the radial pump. Since the seal carrier 15.1 is fixed with respect to the flow medium which rotates in the direction of rotation D a flow S is obtained which redirects the flow medium M as it is indicated symbolically by the arrows. The flow S consequently conducts sea water as a liquid flow medium M from the outer radial area $R_a$ to the inner radial are $R_i$, that is, to the slide ring seal 10 which, as a result, is lubricated and cooled already during start-up operation.

The contour of the deflective surface area LP extends generally in a straight line but transversely at an angle to a radius R of the surface area F. Actually, the deflecting surface extends at an inclination angle with respect to the direction of rotation D. In the present case, the inclination angle with respect to a horizontal radial line r is about 45°, that is, it is within a range of 90° to 0°. As apparent, the flow medium M is collected already during start up operation of the radial pump in front of the web 41 and, as a result of the deflection surface area L, is directed from an outer radial area $R_a$ to an inner radial area $R_i$ as it is symbolically indicated by arrows 5 indicating the flow direction.

Figure 4:
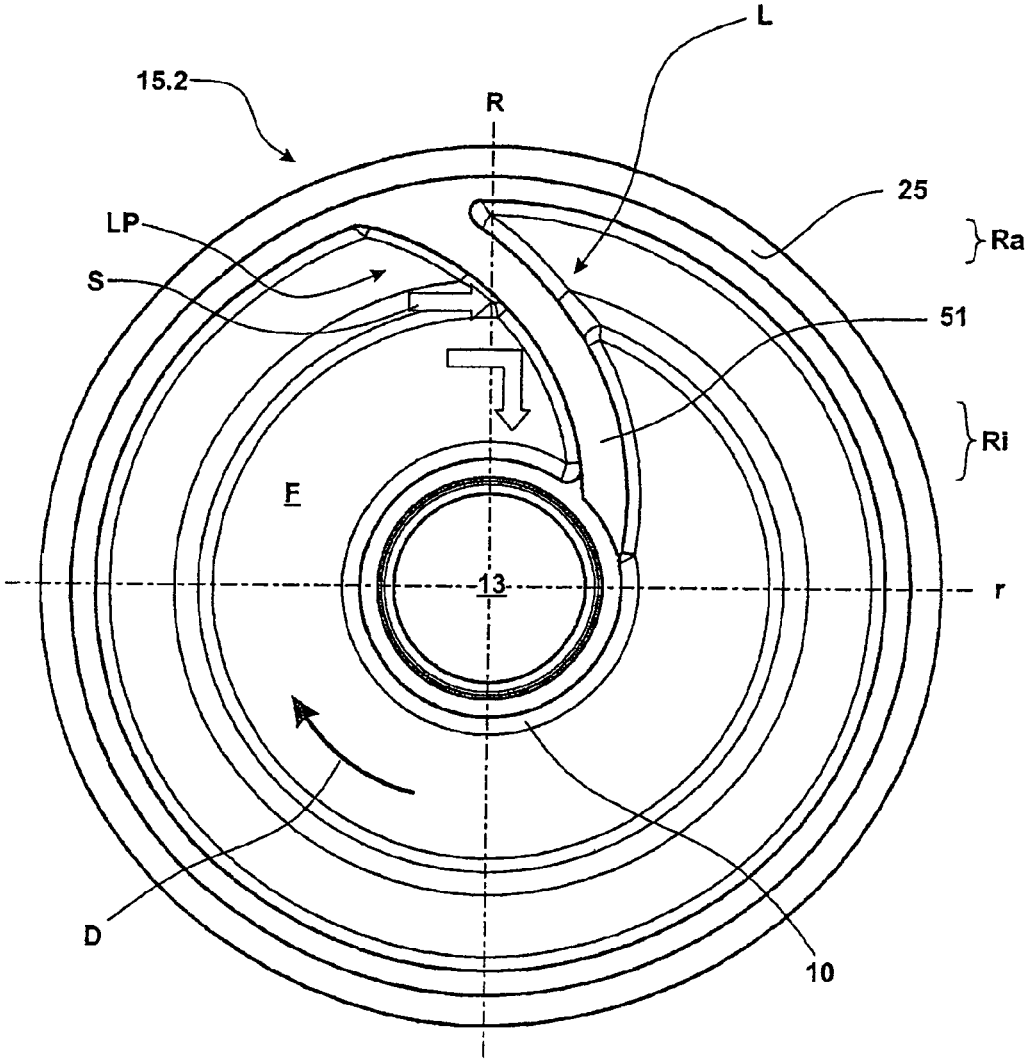
FIG. 4 is an axial view of a seal carrier of a radial pump with a guide structure according to a second embodiment.

FIG. 4 shows a variation of a seal carrier 15.2 for a second embodiment of a radial pump with a guide structure L. The guide structure L is in the form of a web or rib 51 and has a deflecting surface area LP similar to the deflecting area LP of the seal carrier 15.1 of FIG. 3. The contour of the deflecting area LP is mostly curved but otherwise also extends at an inclination with respect to the radius R of an annular chamber, wherein an extrapolation of the contour extends toward the center of the drive shaft 13. In addition, the deflection area L has an inclination also in a direction transverse to the direction of rotation D of the rotating impeller 11. In this arrangement, furthermore, the inclination is increased at the inner radial area $R_i$ that is adjacent the slide ring seal 10 at the drive shaft 13. At the outer radial area $R_a$, the inclination is smaller at the peripheral surface area F. The flow direction S is also in this case symbolically indicated by arrows.

Figure 5:
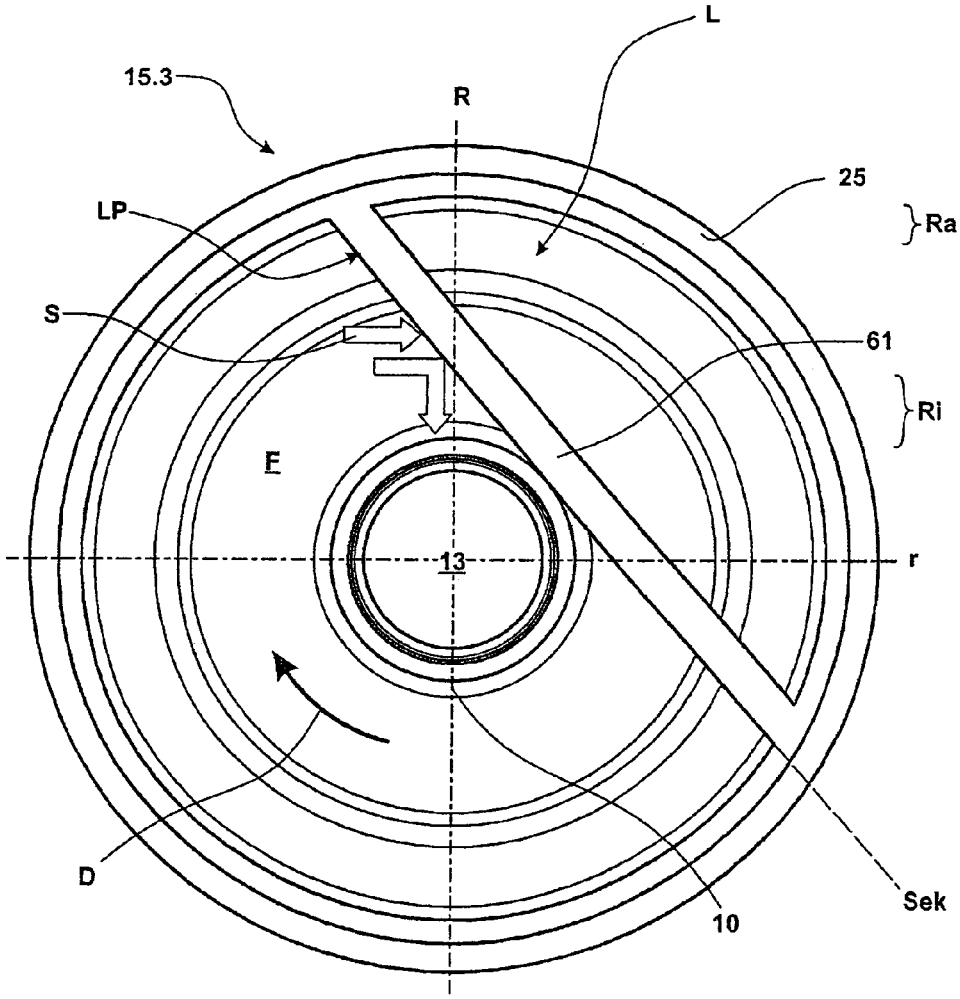
FIG. 5 is an axial view of a seal carrier of a radial pump with a guide structure according to a third embodiment.

FIG. 5 shows a further variation of a seal carrier 15.3 for a third embodiment of a radial pump. It includes a seal carrier 15.3 wherein the guide structure L is provided by a rib 61 which extends along a straight line and has a deflection surface area LP in the form of a side surface of the web or rib 61. The deflection surface area LP projects from the surface 7 and provides in principle for a flow as it is shown in connection with FIG. 3, that is, a flow S from an outer radial area $R_a$ to an inner radial area $R_i$. The contour of the deflection surface area LP extends mainly along a secant $S_{ek}$ for the surface area F. The secant $S_{ek}$ extends tangential to the slide ring seal 10 or, respectively, tangential to the circumference of the drive shaft 13. Finally, the web 61 extends throughout along the length of the secant $S_{ek}$ through the area F at the front side 25 of the seal carrier 15. While the web 41, 51 is limited on the surface area F to an area of a radius R, the web 61 and the section A of FIG. 6 extend over the whole area F along the full secant $S_{ek}$.

Figure 6:
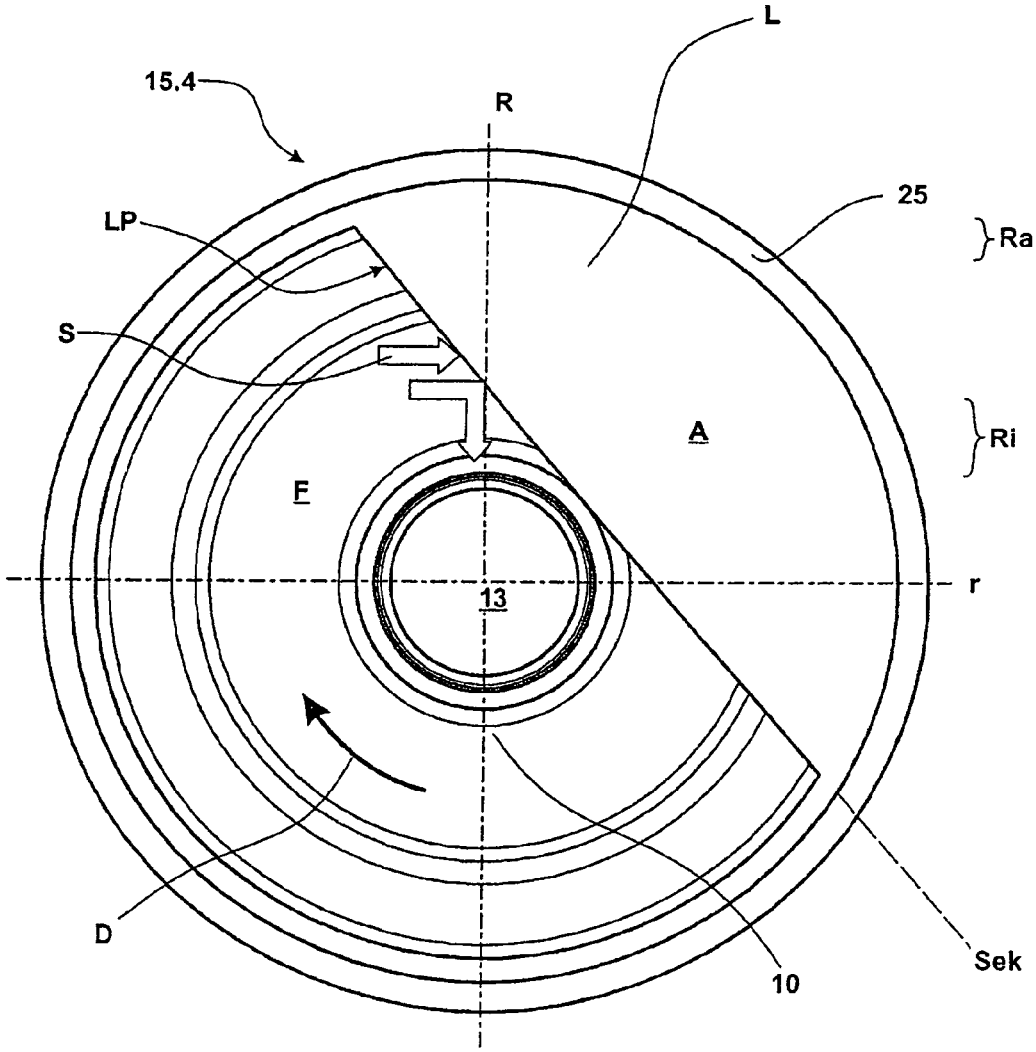
FIG. 6 is an axial view of a seal carrier of a radial pump with a guide structure according to a fourth embodiment.

FIG. 6 shows a fourth embodiment with a further modified seal carrier 15.4 in an axial view of the front side 25 and the surface area F facing the impeller 11. The guide structure L is formed in this variation provided with a deflection surface area LP which is formed as a result of a raised section A with respect to surface area F. The section A is not profiled—unlike the surface area F of the front side 25. As a result, a deflection surface area LP is formed which extends along the secant $S_{ek}$ of the surface area F. The guide structure is provided with a single deflection surface area LP. The seal carriers 15.1, 15.2, 15.3 of the FIGS. 3 to 5 have first and second deflection surface areas LP formed by opposite sides of a web or rib 41, 41 and 61. The main part of a flow deflection is caused here by the deflection area LP which directly faces the direction of rotation D at the webs or ribs 41, 51, 61, that is, the front side surface areas.

With the seal carrier 15.4 of FIG. 6, the comparatively simple arrangement wherein the section A of the front side 25 is a planar surface area and the remaining surface area F of the front side 25 is structured, provides for a single deflection surface area LP. The guide structure L with the deflection surface area LP has an effect on the flow medium M as it is shown in principle in the FIGS. 3-5 by the flow indicated by the arrows, that is, it leads to a re-distribution of the centrifugal force-caused distribution of the flow medium M from the outer radial area $R_a$ to the inner radial area $R_1$. This provides in accordance with the invention during initial operation of the radial pump also for a sufficient cooling and lubrication of the slide ring seal 10.

In summary, the invention resides in a centrifugal pump 1 in particular a radial pump or a semi-axial pump comprising:

a housing 3 with a pumping chamber 5 and a dry space 7;

a drive shaft 13 rotatably supported with respect to the housing 3 and an impeller 11 firmly connected to the drive shaft 13 for pumping a liquid flow medium M present in the pumping chamber 5; and a shaft seal arranged in an inner radial area $R_1$ for sealing the dry space with respect to the flow medium 11, wherein at least part of the shaft seal is fixed to a seal carrier 15 connected to the housing 3. In accordance with the invention, the seal carrier 15 is provided with a surface area F which axially faces the impeller 11 and includes a guide structure L by which, with the impeller rotating during operation, flow medium M can be conducted from an outer radial area $R_a$ to an inner radial area $R_i$, wherein the guide structure L includes at least one guide surface which projects axially from the surface area F and which is inclined transverse to the direction of rotation D of the impeller during operation thereof and which has a contour extending from the outer radial area $R_a$ the inner radial area $R_i$.

What is claimed is:

1. A centrifugal pump (1), comprising:

a housing (3) with a pumping chamber (5) and a dry space (7), a drive shaft (13) rotatably supported with respect to the housing (3) with an impeller (11) mounted on the drive shaft (13) for rotation therewith for pumping a liquid flow medium M disposed in the pumping chamber (5), and a shaft seal arranged in an inner radial area $R_i$ for sealing the dry space (7) with respect to the flow medium (M), and at least part of the shaft seal being fixed to a seal carrier (15) connected to the housing (3), the seal carrier (15) having a surface area which axially faces the impeller (11) and which is provided with a guide structure (L) by which, with the impeller (11) rotating during operation, a flow medium (M) is conducted from an outer radial area ($R_a$) to the inner radial area ($R_i$), the guide structure (L) including at least a guide area which projects axially from the surface area (F), and which extends in a straight line at an angle with respect to a direction of rotation (D) of the impeller (11) and extends in the form of a secant from the radially outer area ($R_a$) tangentially to the circumference of the drive shaft (13) to the inner area ($R_i$) and back to the radial outer area.

2. The centrifugal pump (1) according to claim 1, wherein the outer radial area ($R_a$) and the inner radial area ($R_i$) are areas of an annular chamber (23) disposed axially between the seal carrier (15) and the drive shaft (13) of the impeller (11).

3. The centrifugal pump (1) according to claim 2, wherein the annular chamber (23) includes the flow medium (M) and is disposed axially between the pumping chamber (3) and the dry space (7) and also includes a pressure relief bore (29).

4. The centrifugal pump according to claim 1, wherein the shaft seal is a slide ring seal (10), wherein at least a part of the shaft seal is a counter ring (10.1) which is fixed to the seal carrier (15) and wherein another part of the shaft seal is a slide ring (10.7) which is fixed to the impeller (11).

5. The centrifugal pump according to claim 1, wherein the guide surface area is in the form of a deflection area LP projecting from the surface area (F) formed by the side surfaces of a rib or a web which projects from the surface area (F).

6. The centrifugal pump according to claim 1, wherein a height (h) of a guide surface extending from the surface area (F) corresponds essentially to the height (H) of a part of the shaft seal.

7. The centrifugal pump according to claim 1, wherein the guide structure (L) is firmly but releasably connected to the seal carrier (15).

8. A system comprising a centrifugal pump (10) according to claim 1, and a drive for the pump which drive includes an internal combustion engine.

* * * * *